US005664401A

United States Patent [19]

Portrait et al.

[11] Patent Number: 5,664,401

[45] Date of Patent: Sep. 9, 1997

[54] CARTON FOLDING MECHANISM FOR WRAPAROUND CARTONS

[75] Inventors: Pascal Portrait, Nuret-le-Ferron; Jean-Christophe Bonnain, Chateauroux, both of France

[73] Assignee: The Mead Corporation, Dayton, Ohio

[21] Appl. No.: 446,764

[22] PCT Filed: Sep. 23, 1994

[86] PCT No.: PCT/US94/10787

§ 371 Date: Jun. 2, 1995

§ 102(e) Date: Jun. 2, 1995

[87] PCT Pub. No.: WO95/08477

PCT Pub. Date: Mar. 30, 1995

[30] Foreign Application Priority Data

Sep. 24, 1993 [GB] United Kingdom ..... 9319970

[51] Int. Cl.[6] ..... B65B 21/24

[52] U.S. Cl. ..... 53/48.6; 53/48.7; 53/48.8; 53/48.9; 53/387.2

[58] Field of Search ..... 493/177; 53/387.2, 53/564, 48.6, 48.7, 48.8, 48.9

[56] References Cited

U.S. PATENT DOCUMENTS

| | | | |
|---|---|---|---|
| 3,032,945 | 5/1962 | Currie et al. | 53/564 X |
| 3,254,470 | 6/1966 | Currie | 53/48.9 X |
| 3,387,428 | 6/1968 | Currie | 53/48.9 X |
| 4,563,853 | 1/1986 | Calvert | 53/48.9 |
| 4,612,753 | 9/1986 | Taylor et al. | 53/48.9 X |
| 4,970,843 | 11/1990 | Lour et al. | 53/48.9 X |

FOREIGN PATENT DOCUMENTS

| | | |
|---|---|---|
| 0 200 445 | 11/1986 | European Pat. Off. . |
| 0 242 992 | 10/1987 | European Pat. Off. . |
| 0 322 159 | 6/1989 | European Pat. Off. . |

*Primary Examiner*—Daniel Moon

*Attorney, Agent, or Firm*—Tsugihiko Suzuki

[57] ABSTRACT

A flap-folding device for use in a packaging machine comprises a rotational disc, drive means for rotating the disc in synchronization with movement of a blank and articles to be packaged in the blank, a pair of blank-engaging fingers pivotally mounted on the disc to fold flaps on the blank, and actuating means for pivotally moving the fingers. The actuating means comprises a radial member mounted on the disc for reciprocating movement along the radius of the disc, cooperating means for moving the radial member along the radius in response to rotation of the disc, and means for converting reciprocating movement of the radial member into pivotal movement of the fingers.

10 Claims, 7 Drawing Sheets

CARTON FOLDING MECHANISM FOR WRAPAROUND CARTONS

BACKGROUND OF THE INVENTION

This invention relates to a carton folding mechanism for a machine for packaging articles in, for example, a sleeve type wraparound carton. Typically the carton is formed from a paperboard blank in which a side wall panel and base panel are hinged together along a fold line. Article apertures, for example, bottle heel retaining apertures incorporating hinged retaining flaps are disposed astride the fold line between the carton panels. The machine in which the mechanism of the present invention may be incorporated includes a conveyor for advancing a blank and the articles to be packaged along a predetermined feed path. The mechanism folds such retaining flaps into their required positions inwardly of the carton. The present invention is concerned with the inward folding of pairs of such retaining flaps associated with each article retention apertures. The flaps of each pair of flaps are engaged and folded inwardly while the adjacent portions of the blank are held against any substantial sidewise movement by suitable guide means.

It is known from EP-0 200 445 to provide article retaining features such as bottle heel retention apertures in the base and side walls of a wraparound carton which receive a heel portion of an article such as a bottle packaged in the carton. Such heel retaining features normally are struck from the side and base wall panels of a wraparound carton and comprise flaps which are hingably attached to the carton panel. In the flat blank the flaps close the apertures which are to provide the bottle heel retention apertures of the carton. When the blank is applied to a group of articles, it is known to open the flaps using a simple finger mechanism to later enable the heel of the article to be received in the aperture created.

A mechanism for achieving this function is disclosed in EP-0 200 445 and comprises a mechanism for engaging and folding a pair of bottle heel retention flaps so that the flaps are folded inwardly of the carton. The folding mechanism includes a pivotal folder comprising a pair of pivotal fingers which are cam actuated so as to execute a folding movement whereby the fingers progressively enter a retention aperture in the blank to fold the flaps and to execute a retracting movement. These folding and retracting movements occur during linear feed movement of the carton blank and the pivotal folder together. The pivotal folders operate sequentially upon a blank to fold open a row of such heel retention flaps and, in a folding section of the machine, move together with the blank through the machine. In order to actuate the pivotal fingers each pivotal folder engages a fixed cam track formed in a cam block and is conveyed through a working path and a return path of a chain and sprocket assembly.

SUMMARY OF THE INVENTION

The invention provides a device for use in a machine for packaging articles in a wraparound carrier of the type formed from a blank having a pair of walls adjoined together along a fold line and having a pair of article retaining and blank reinforcing flaps disposed astride said fold line said device comprising folding means for engaging and folding said pair of flaps and to fold such flaps inwardly of the carrier, said folding means comprising a folder adapted to execute a folding movement thereby progressively to enter an aperture in the blank to fold the flaps and to retract therefrom during feed movement of the blank, said folder including a blank engaging portion and means for cooperation with actuating means to pivot the blank engaging portion thereby to execute said folding movement and said retracting movement wherein said folder is radially movable with respect to an axis of the device and said blank engaging portion comprises a pair of divergently pivotal fingers adapted to pivot upon radial movement of the folder with respect to said axis.

According to a feature of the invention, said cooperating means may comprise a cam follower which rides in an endless cam track contoured so as to cause said folding movement and said retracting movement.

According to another feature of the invention, said folding means may comprise a rotatable plate assembly incorporating said folder and said endless cam track.

In constructions where a plate assemble is provided the plate assembly may comprise, in axial series, a cam plate, an intermediate plate incorporating said folders and a top plate and wherein the intermediate and top plates are rotatable relative to the cam plate. Preferably, the plates are discs.

According to yet another feature of the invention, said folder may comprise a body which is mounted for radial movement in said intermediate plate which body carries said cam follower. The body may terminate in a head comprising a pair of pivotal fingers which provide the blank engaging portion of said folder. Preferably, the pivotal fingers are caused to pivot substantially simultaneously and cooperate with parts of said intermediate plate to effect their pivotal movement.

According to a still further feature of the invention said body may be slidably mounted in a radial track provided in the intermediate disc.

According to another feature of the invention said plate assembly may comprise a plurality of folders arranged in discrete groups whereby a separate one of each group of folders is provided for each successive carton to be engaged.

BRIEF DESCRIPTION OF THE DRAWINGS

An embodiment of the invention will now be described, by way of example only, with reference to the accompanying drawings, in which.

DETAILED DESCRIPTION OF THE PREFERRED EMBODIMENT

Figure 1:
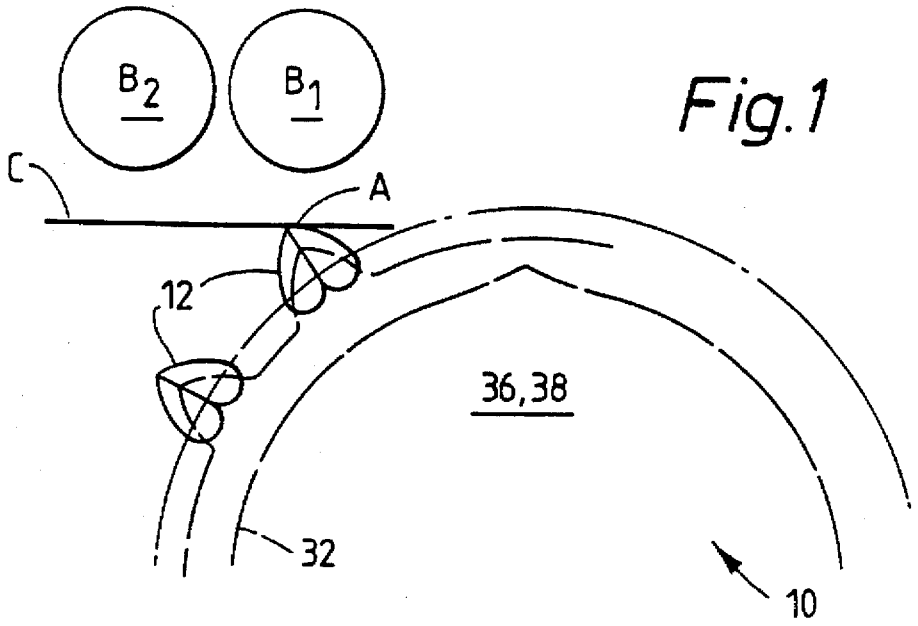
FIGS. 1 to 10 show different stages of the following operation of a mechanism according to the invention.
Figure 2:
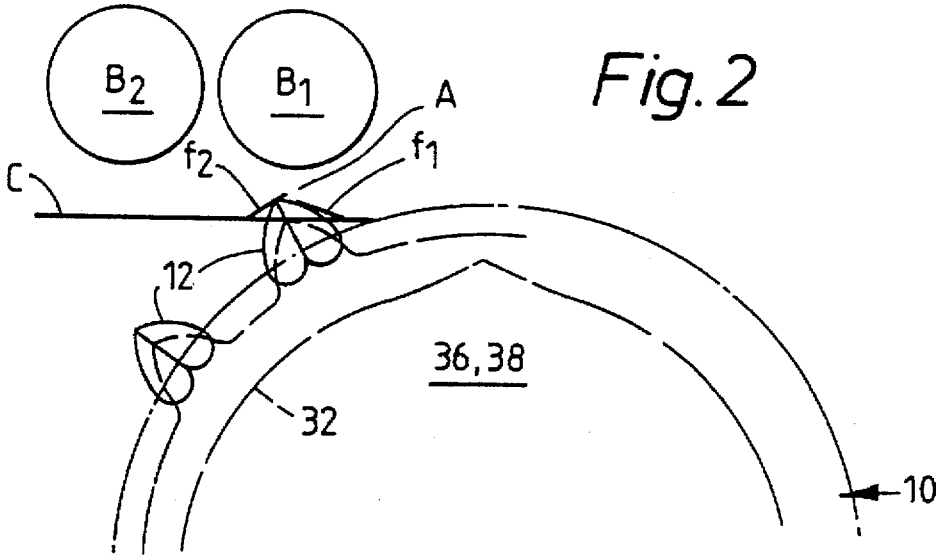

Referring to the drawings, FIGS. 1 to 10 are a schematic representation of the operation of a carton flap opening mechanism 10 according to the invention. The mechanism comprises a number of sets of rotatably mounted folders to cooperate sequentially with a carton blank adapted to provide two heel retention apertures at each side of the carton. FIGS. 1–10 illustrate the sequential steps during rotation of a rotatable plate assembly 36, 38 on which a pair of such folders 12 are carried to effect the opening of heel retention apertures A by, in each case, displacing a pair of flaps $f_1$, $f_2$ of a carton blank C. In this case the carton blank is of the wraparound type. The heel portions of a pair of bottles $B_1$, $B_2$ are then received in respective ones of the retaining apertures A.

Figure 11:
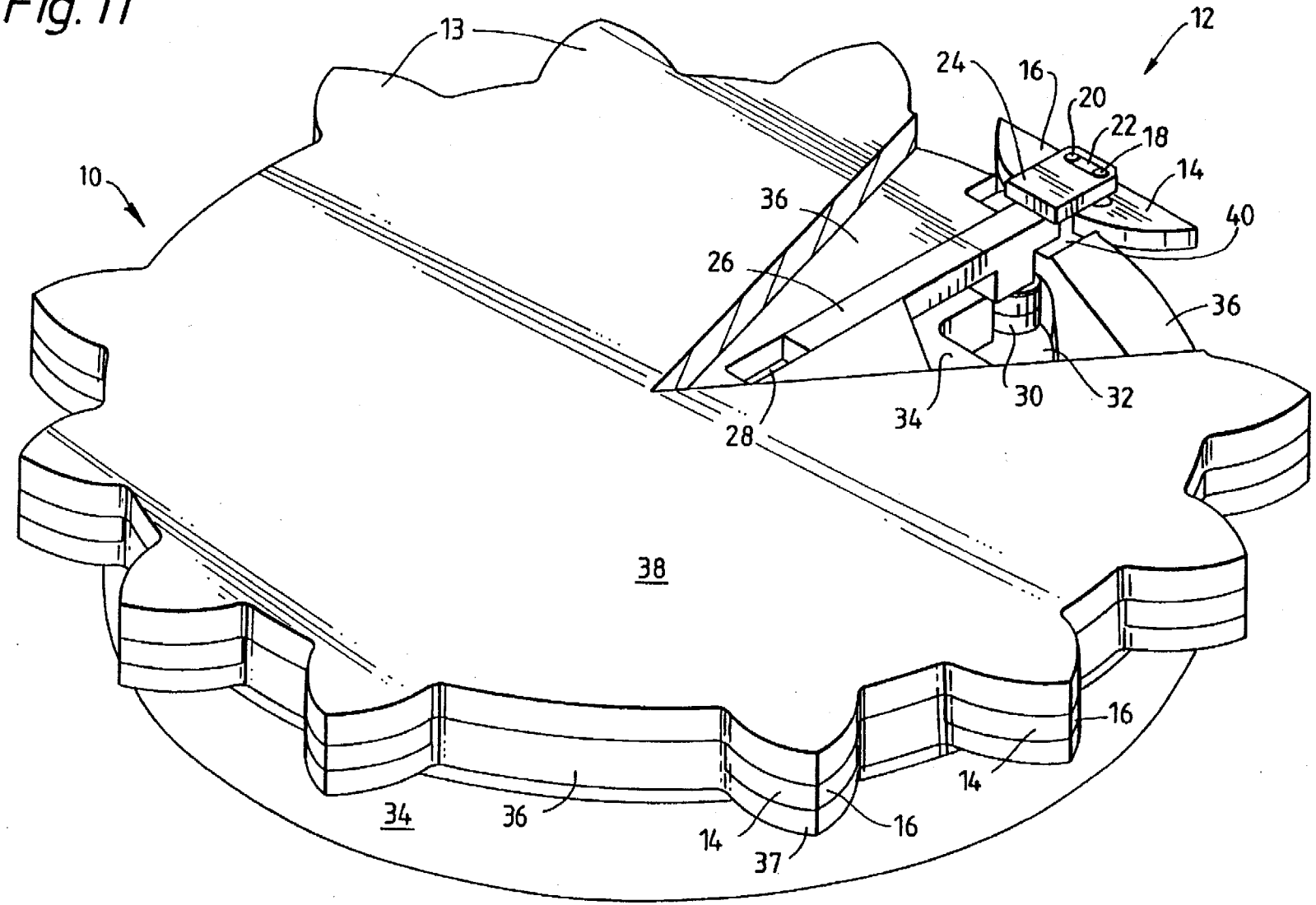
FIG. 11 shows a schematic perspective view of the mechanism according to the invention shown partly broken away.

FIG. 11 is a schematic perspective view of the rotatable disc plate mechanism 10 which comprises an upper disc 38, an intermediate disc 36 and a lower fixed cam plate 34. The discs can be driven, for example, by a shaft fixed to each of the discs and rotatably journalled through the centre of the fixed cam plate. The shaft may of course be connected to be driven through some suitable form of mechanical linkage to a motor in order to effect the correct rotational speed of the wheel assembly in synchronisation with the movement of the carton blank C in the packaging process. The opening mechanism 10 in this example, comprises three series of four closely and equally spaced folders. The number and spacing of each of the folders 12 is determined by the type of carton being used to package articles. In this specific example, the cartons are configured to package a 4×2 arrangement so that a row of four articles will be disposed along each side wall of the carton. Hence, since there are three groups of four pivotal folders, one revolution of the wheel assembly will effect the opening of heel retention flaps in three successive carton blanks. The carton C comprises a side wall having apertures A for receiving heel portions of articles B and flaps "f" struck from the carton side wall which are required to be opened out of the flat plane of the side wall, inwardly of the carton.

A pair of blank folding mechanisms 10 is adapted to be installed adjacent the infeed end of a packaging machine. Two such mechanisms are installed in side-by-side relationship so that a blank and article feed path is provided between the mechanisms. The description hereinafter refers to only one mechanism of the pair the other mechanism being similar in all aspects. The carton blank is formed with a linear series of article heel retaining apertures A which are struck along the fold line which foldably connects a side wall panel with a bottom panel of the blank. Such heel retaining apertures are provided to receive e.g. heel portions of bottles to assist retention of the bottles in the completed carton. The heel retaining apertures are each defined in part, by foldable reinforcing flaps f which are foldable, to open the aperture, into overlapping relationship with adjacent portions of the side wall and base panel of the blank.

Figure 12:
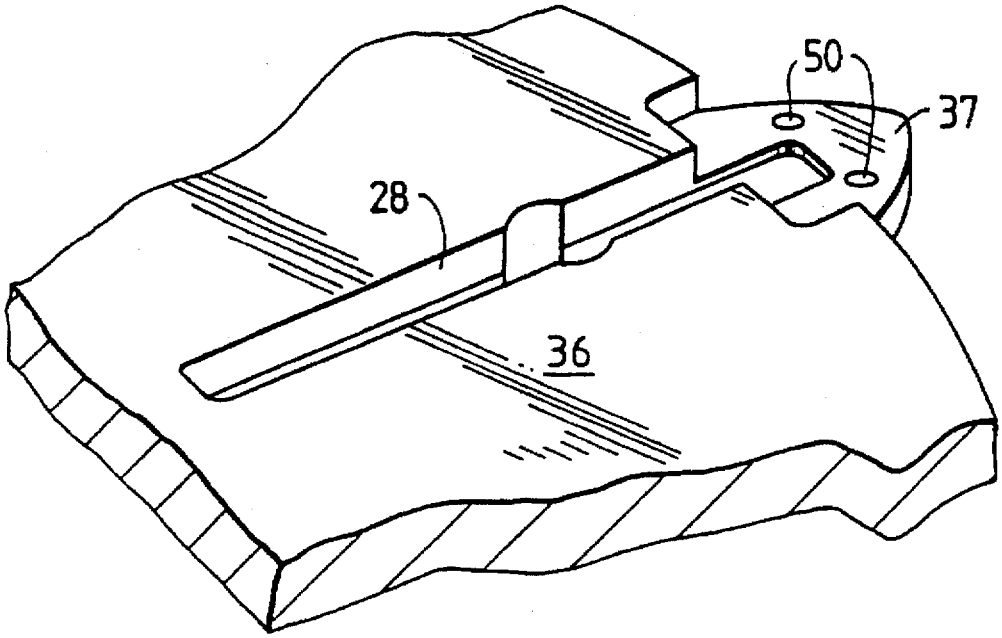
FIG. 12 is a perspective view of part of the mechanism shown in FIG. 11.
Figure 13:
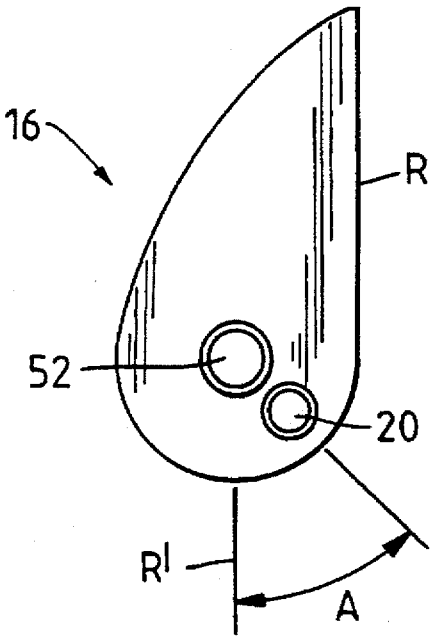
FIG. 13 is a plan view of a pivotal finger which forms part of a folder device according to the invention.
Figure 14:
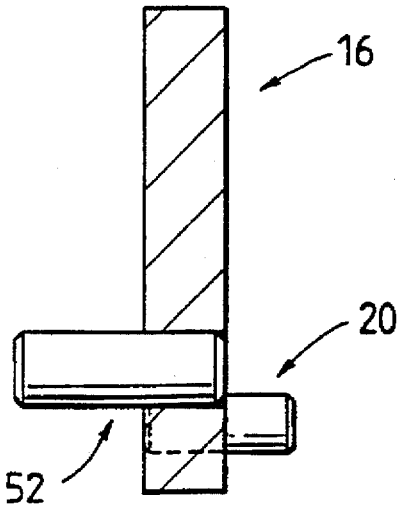
FIG. 14 is a sectional side view of the finger shown in FIG. 13.

An individual folder 12 from one of the three groups is shown in FIG. 11 wherein first and second fingers 14 and 16, respectively, are shown in their fully opened position in which they protrude from recess 40 in disc 36. Each pivotal folder comprises an elongate rod 26 which is received in a radial track 28 formed in intermediate disc 36 for reciprocal movement therein. The radially outer end of rod 26 carries a head plate 24 formed with an ovate transverse opening 22. The pivotal fingers 14 and 16 have upper locating pins 18 and 20 respectively which are slidably received in opening 22 and each have a lower locating pin 52 which are each received in a recess 50 formed in a protruding portion 37 of disc 36. The latter components are shown in FIGS. 12 to 14. It can be seen from the plan view of FIG. 13 that pin 20 is displaced from the centre of pin 52 in order to effect the opening movement of fingers 14 and 16 during radial movement of rod 26. Preferably the angle A subtended by the axis of pin 20 at the axis of pin 52 relative to a line R' parallel to radial edge R of finger 16, which edge forms the edge which abuts finger 14, is in the order of 45°.

A cam follower, in this case a roller assembly 30, depends from the lower face of rod 26 intermediate its ends and rolls in a cam track 32 formed in cam plate 34. The pivotal fingers 14 and 16 are caused to move through the action of the reciprocating rod 26 which moves radially inwardly and outwardly along the radial track 28 in response to radial movement of the cam follower 30 in cam track 32. The cam track 32 is shown schematically in each of the FIGS. 1 to 10 and thus the location of fingers 14 and 16 with respect to their position in relation to cam track 32 can be followed in each of the same figures. As is apparent, the pivotal fingers are opened to their maximum extent (as shown in FIG. 11) when reciprocating rod 26 is at its radially outermost limit and thus when cam follower 30 reaches the most eccentric part of cam track 32.

FIG. 11 is, of course, only schematic, and it is apparent that each protruding portion 13 of upper disc 38 is provided in its lower surface with a radial groove (not shown) for receiving head plate 24 thereby to enable radial movement of head plate 24.

Referring again to FIGS. 1 to 10 it can be seen that as the disc assembly 36, 38 is caused to rotate clockwise, a first folder 12 engages a carton blank and penetrates an aperture A thus separating the flaps $f_1$, $f_2$ from co-planar alignment with the side panel of the carton. In FIG. 1, folder 12 has rotated into abutment with the side of carton blank C, whereas in FIG. 2, further rotation has caused initial penetration of folder 12 into the heel retaining aperture A.

Figure 3:
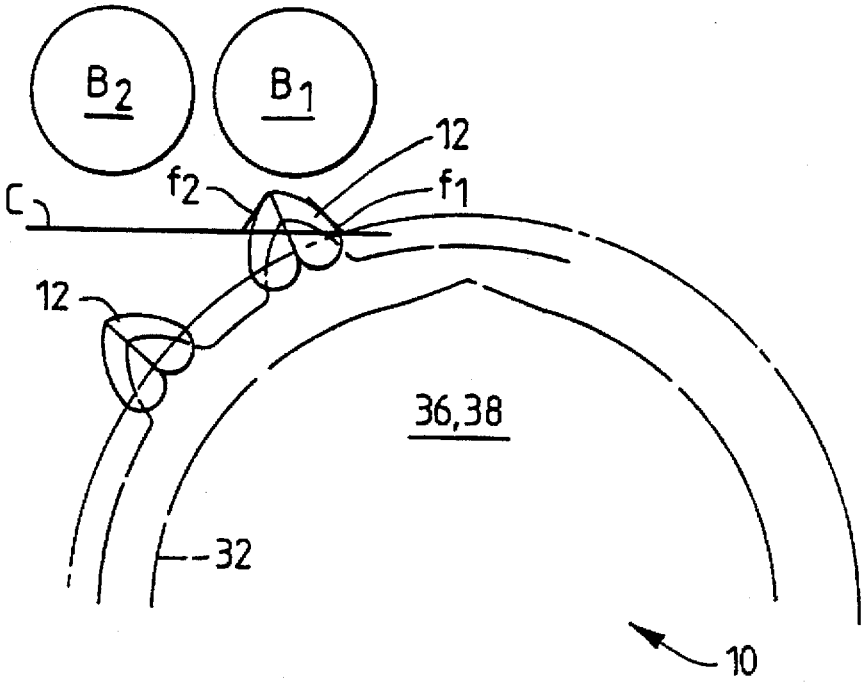
Figure 4:
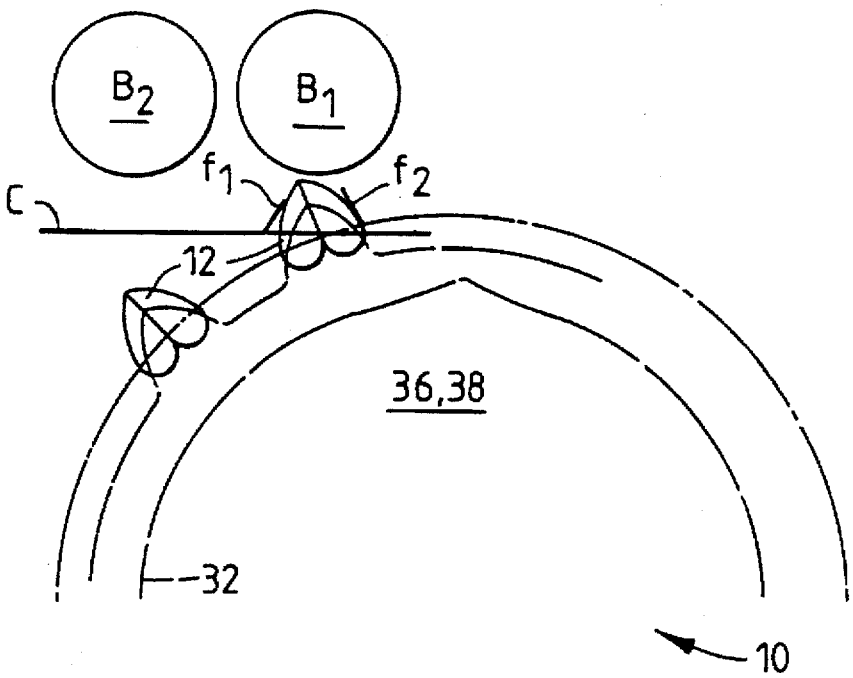
Figure 5:
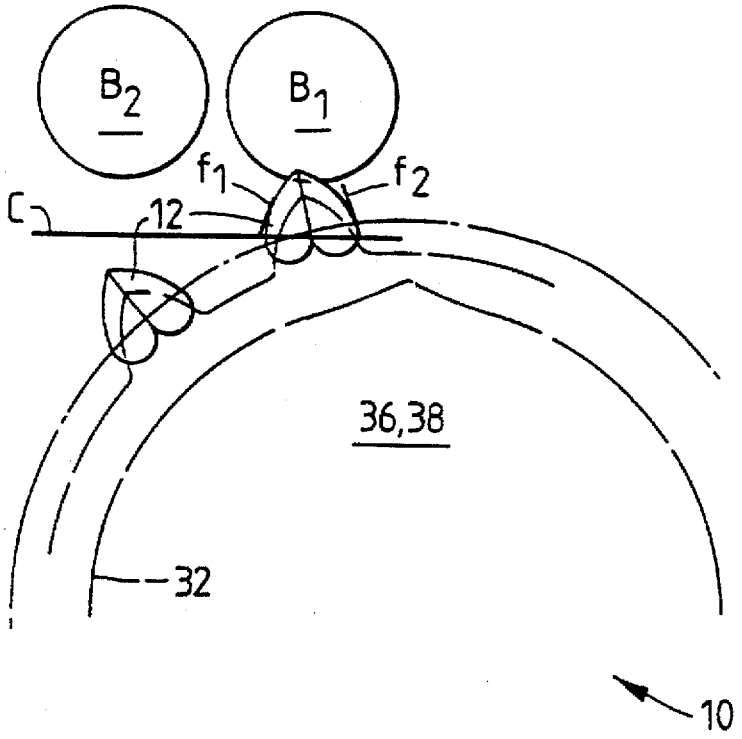

FIG. 3 illustrates folder 12 at a position where it has almost entirely penetrated the aperture A causing the flaps $f_1$, $f_2$ to fold inwardly away from one another significantly, but not beyond a 90° position relative to the carton side panel. This is the situation also for the next sequence of events up to and including the position shown in FIG. 5. It will be appreciated that up to this position the pivotal fingers of the folder 12 remain closed even though they have penetrated the blank.

Figure 6:
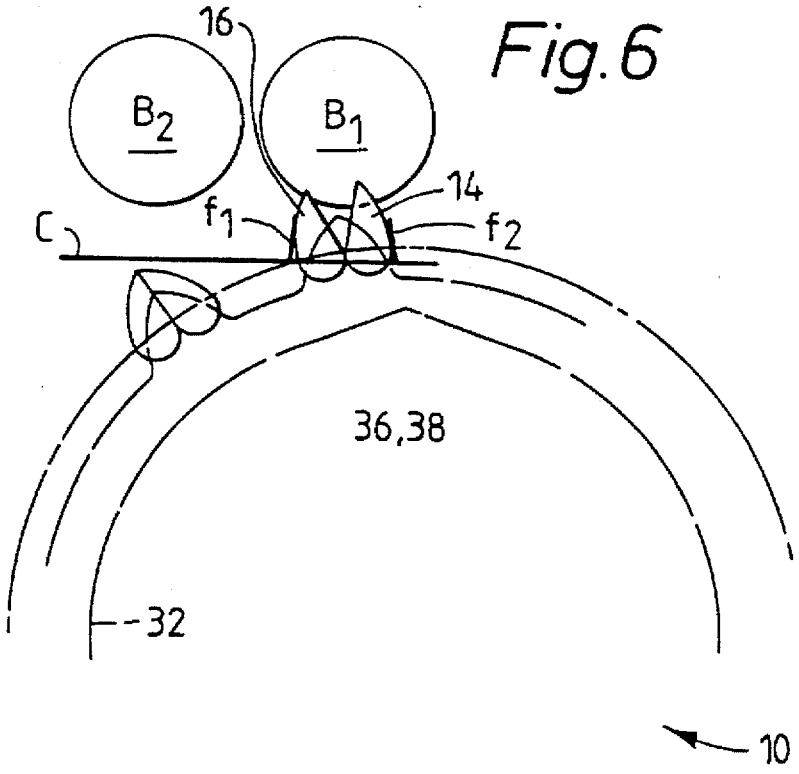

In FIG. 6 the pivotal fingers 14 and 16 begin to pivot apart from one another and thus open folding flaps $f_1$, $f_2$ still further.

Figure 7:
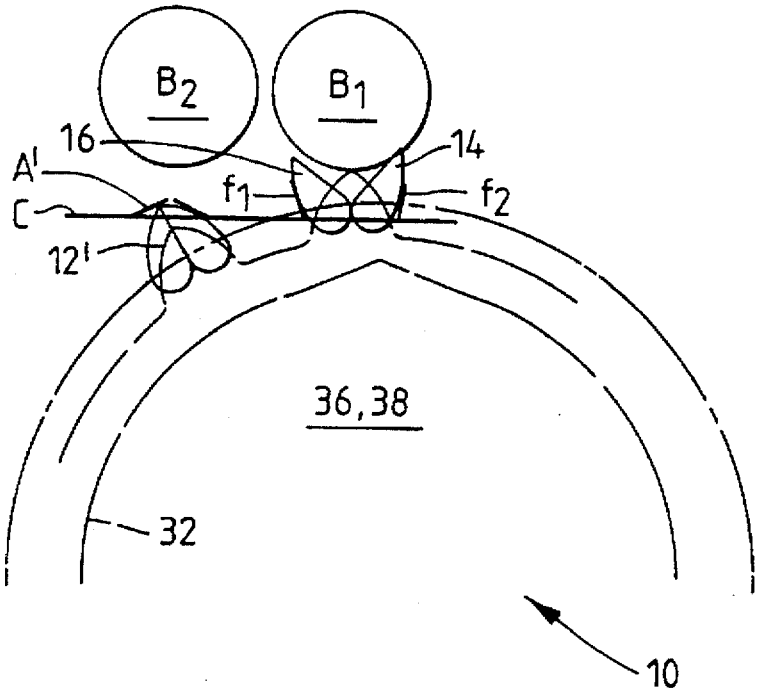

In FIG. 7 the flaps $f_1$, $f_2$ have been folded beyond the 90° position relative to the associated carton side wall and begin to be folded towards adjacent parts of the carton side wall. The second folder $12^1$ is at that time beginning to penetrate the next adjacent aperture $A^1$ having flaps $f_3$, $f_4$.

Figure 8:
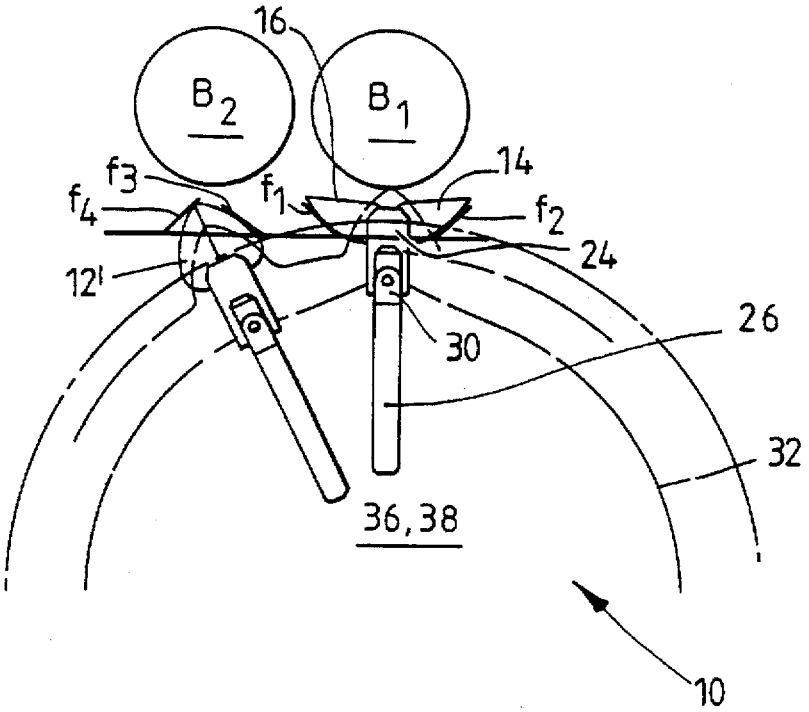

In FIG. 8 cam follower 30 has reached the radially outermost part of cam track 32 and thus reciprocating rod 26 causes head plate 24 to reach its radially outermost position. Hence, this causes maximum opening of the pivotal fingers 14 and 16 due to the action of plate 24 on locating pins 18 and 20 received in groove 22.

Figure 9:
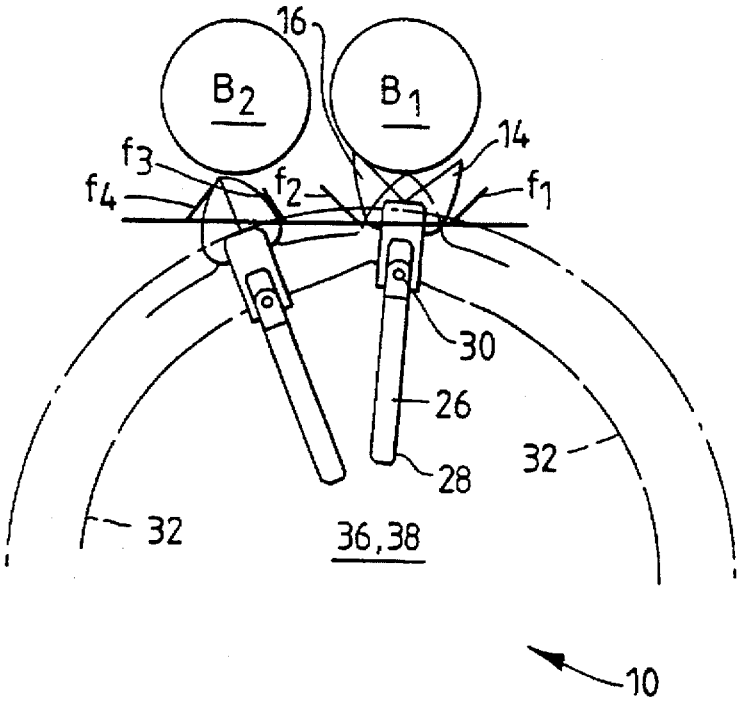
Figure 10:
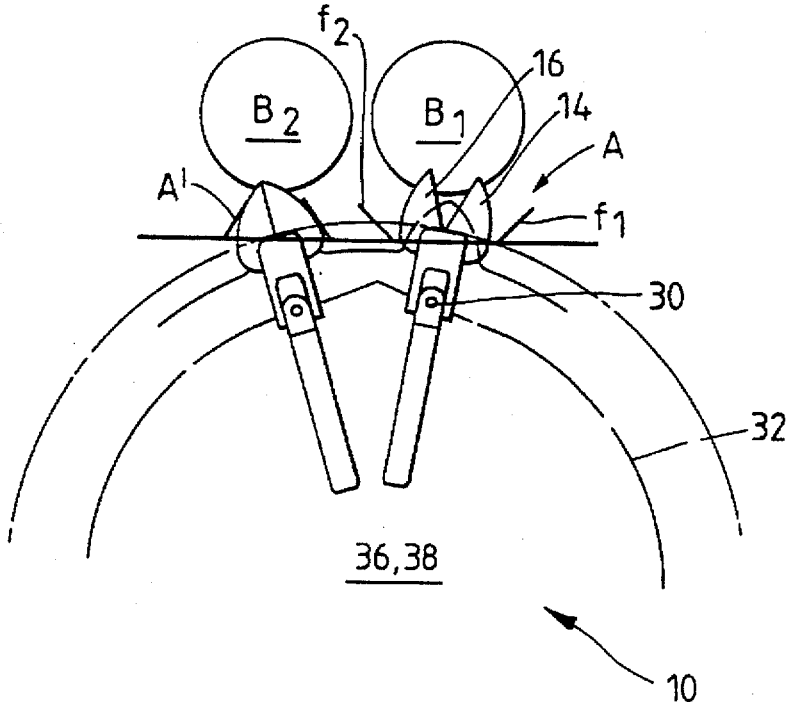

FIG. 9 shows that cam follower 30 has passed the radially outermost extent of cam track 32 and that rod 26 is caused to retract thereby causing the pivotal fingers 14 and 16 to begin to close back together.

in FIG. 10 the pivotal fingers 14 and 16 are brought even closer together and thereby enable the fingers to be retracted from the aperture A.

Thus, when the fingers are pivoted into their extreme outward position, the fingers move apart to engage and fold outwardly the tabs of the heel retaining aperture and when the fingers are pivoted into their fully retracted position, the fingers are closed together.

During this operation it is apparent from the schematic drawings 1 to 10 that the pivotal fingers operate adjacent the bases of the bottles, $B_1$, $B_2$. The bottle heels are then engaged in their respective heel apertures as the carton side panels move inwardly. This occurs by bringing the carton base panels into overlapping relationship which has the general effect of 'tightening' the carton blank about the group of bottles. In this specific example, all four adjacent apertures will have been opened before the wraparound carton is closed about the group of bottles.

It is apparent from the drawings that the pivotal fingers 13,14 of the folders have a curved outer profile in order better to effect penetration of aperture A and to enable a progressive folding effect in the expansion of the flaps $f_1$, $f_2$. It will be appreciated that an opening mechanism 10 according to the invention can be readily modified so as to operate in conjunction with cartons of a different configuration to those described here. Thus change-over from one carton form to another different form simply requires the removal of the current disc assembly and the substitution of another appropriate disc assembly whose diameter, pivotal finger grouping and number and rotational speed of the assembly are matched to the type of carton to be run on the machine. This is in contrast to the considerably more laborious change-over requirements of the known mechanism in which the number and spacing of the pivotal fingers often would need to be individually adjusted on the endless chain assembly.

We claim:

1. A device for use in a machine for packaging articles in a wraparound carrier which is formed from a blank having a pair of foldable flaps struck therefrom and defining an aperture therein, said machine being arranged to advance said blank and articles associated therewith along a predetermined path, said device being positioned along said path to fold said flaps inwardly of said blank, said device comprising:

a rotational disc defining an axis of rotation;

drive means for rotating said rotational disc about said axis in synchronization with movement of said blank and said articles;

a pair of blank-engaging fingers mounted on said rotational disc such that when said disc is rotated, said fingers are progressively moved into said aperture to fold said flaps and are subsequently retracted from said aperture, said fingers being pivotally connected to said disc for movement about respective first pins; and actuating means for pivotally moving said fingers away from each other during progressive movement of said fingers and toward each other during retracting movement of said fingers, said actuating means comprising a radial member mounted on said disc for reciprocating movement along a radius of said disc, cooperating means for moving said radial member along said radius in response to rotation of said disc, and means for converting reciprocating movement of said radial member into pivotal movement of said fingers so that said fingers are simultaneously pivoted about said first pins in response to reciprocating movement of said radial member.

2. The device according to claim 1, wherein said converting means comprises a header mounted on said radial member and connected to said fingers such that said fingers are pivoted away from each other when said radial member is moved radially outwardly and toward each other when said radial member is moved radially inwardly.

3. The device according to claim 2, wherein each of said fingers has a second pin disposed at a position displaced from a respective one of said first pins, and said header has a transverse opening slidably receiving said second pins of said fingers.

4. The device according to claim 2, wherein said cooperating means comprises an endless cam track disposed around said axis, and a cam follower connected to said radial member and riding in said track so as to cause reciprocating movement of said radial member during rotation of said disc.

5. A machine for packaging articles in a wraparound carrier formed from a blank having a pair of foldable flaps struck therefrom and defining an aperture therein, said machine comprising conveyor means for advancing said blank and articles associated therewith along a predetermined path, and a folding device positioned along said path to fold said flaps inwardly of said blank, said folding device comprising:

a rotational disc defining an axis of rotation;

drive means for rotating said rotational disc about said axis in synchronization with movement of said blank and said articles advanced by said conveyor means;

a pair of blank-engaging fingers mounted on said rotational disc such that when said disc is rotated, said fingers are progressively moved into said aperture to fold said flaps and are subsequently retracted from said aperture, said fingers being pivotally connected to said disc for movement about respective first pins; and actuating means for pivotally moving said fingers away from each other during progressive movement of said fingers and toward each other during retracting movement of said fingers, said actuating means comprising a radial member mounted on said disc for reciprocating movement along a radius of said disc, cooperating means for moving said radial member along said radius in response to rotation of said disc, and means for converting reciprocating movement of said radial member into pivotal movement of said fingers so that said fingers are simultaneously pivoted about said first pins in response to reciprocating movement of said radial member.

6. The packaging machine according to claim 5, wherein said converting means comprises a header mounted on said radial member and connected to said fingers such that said fingers are pivoted away from each other when said radial member is moved radially outwardly and toward each other when said radial member is moved radially inwardly.

7. The packing machine according to claim 6, wherein each of said fingers has a second pin disposed at a position displaced from a respective one of said first pins, and said header has a transverse opening slidably receiving said second pins of said fingers.

8. The packaging machine according to claim 6, wherein said cooperating means comprises an endless cam track disposed around said axis, and a cam follower connected to said radial member and riding in said track so as to cause reciprocating movement of said radial member during rotation of said disc.

9. The packaging machine according to claim 8, wherein said cam track is contoured such that said radial member is moved radially outwardly during progressive movement of said fingers and radially inwardly during retracting movement of said fingers.

10. The packaging machine according to claim 5, wherein said disc is provided with a plurality of pairs of said fingers disposed along a periphery thereof.

* * * * *